US007985080B2

(12) United States Patent
Ai

(10) Patent No.: US 7,985,080 B2
(45) Date of Patent: Jul. 26, 2011

(54) ELECTRICAL CONNECTOR HAVING AUXILIARY HOLD-DOWN ARRANGEMENT

(75) Inventor: Lu-Shan Ai, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 22 days.

(21) Appl. No.: 12/561,520

(22) Filed: Sep. 17, 2009

(65) Prior Publication Data

US 2010/0068940 A1 Mar. 18, 2010

(30) Foreign Application Priority Data

Sep. 17, 2008 (CN) ..... 2008 2 0160350

(51) Int. Cl.
*H01R 12/00* (2006.01)

(52) U.S. Cl. ..... 439/79; 439/570

(58) Field of Classification Search ..... 439/79, 439/567, 83, 570

See application file for complete search history.

(56) References Cited

U.S. PATENT DOCUMENTS 6,086,416 A * 7/2000 Choy ..... 439/567
2009/0170368 A1 7/2009 Higeta et al.

* cited by examiner

*Primary Examiner* — Ross N Gushi
(74) *Attorney, Agent, or Firm* — Wei Te Chung; Andrew C. Cheng; Ming Chieh Chang

(57) ABSTRACT

An electrical connector includes an insulative housing having a front mating surface, a mounting surface, two opposite side surfaces, a plurality of conductive terminals secured in the housing, and at least one board lock secured in the insulative housing. A recess is formed in the mounting surface and defines a lower surface. At least one boardlock-receiving cavity is formed in the lower surface. Each board lock includes a body portion received in the recess and a pair of locking arms extending from two sides of the body portion and received in the boardlock-receiving cavity. The body portion defines an engaging surface coplanar with the mounting surface.

13 Claims, 5 Drawing Sheets

ELECTRICAL CONNECTOR HAVING AUXILIARY HOLD-DOWN ARRANGEMENT

BACKGROUND OF THE INVENTION

1. Field of the Invention

The present invention relates to an electrical connector, and more particularly to an electrical connector having auxiliary hold-down arrangement located adjacent mating interface thereby increasing reliability during mating and unmating with a corresponding connector.

2. Description of Related Art

U.S. Pat. Pub. No. 2009/0170368 filed by Higeta et al. on Dec. 12, 2008 discloses an electrical connector, which comprises an insulative housing with a plurality of contacts received therein and a pair of board locks retained in the housing. Each board lock comprises a fixed portion for being fixed onto the housing and a soldering portion perpendicularly extending from the fixed portion and soldered to a printed circuit board by surface mounting technology (SMT). However, when an opposing mating connector is engaged to or disengaged from the electrical connector, a large force exerts onto the electrical connector so that the electrical connector may be off from the circuit board easily.

It is thus desired to provide an electrical connector having hold-down arrangement.

SUMMARY OF THE INVENTION

Accordingly, an object of the present invention is to provide an electrical connector with hold-down arrangement for reliably positioning the connector on a printed circuit board.

In order to achieve the above-mentioned object, an electrical connector comprises an insulative housing having at least one mating tongue and a bottom wall with a mounting face, a plurality of terminals assembled in the insulative housing, a pair of first board locks retained at two opposite ends of the housing. The insulative housing has at least one mating tongue and a bottom wall with a mounting face, the at least one second board lock secured in the bottom wall of the insulative housing and having an engaging surface coplanar with the mounting surface.

Other objects, advantages and novel features of the present invention will become more apparent from the following detailed description of the present embodiment when taken in conjunction with the accompanying drawings.

DETAILED DESCRIPTION OF THE INVENTION

Figure 1:
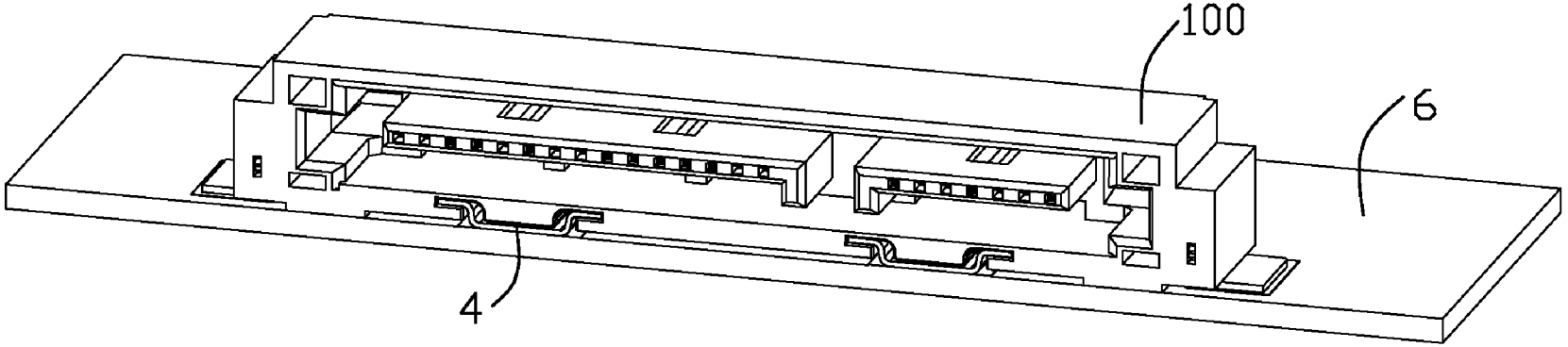
FIG. 1 is an assembled, perspective view of an electrical connector assembly according to an embodiment of the present invention.
Figure 2:
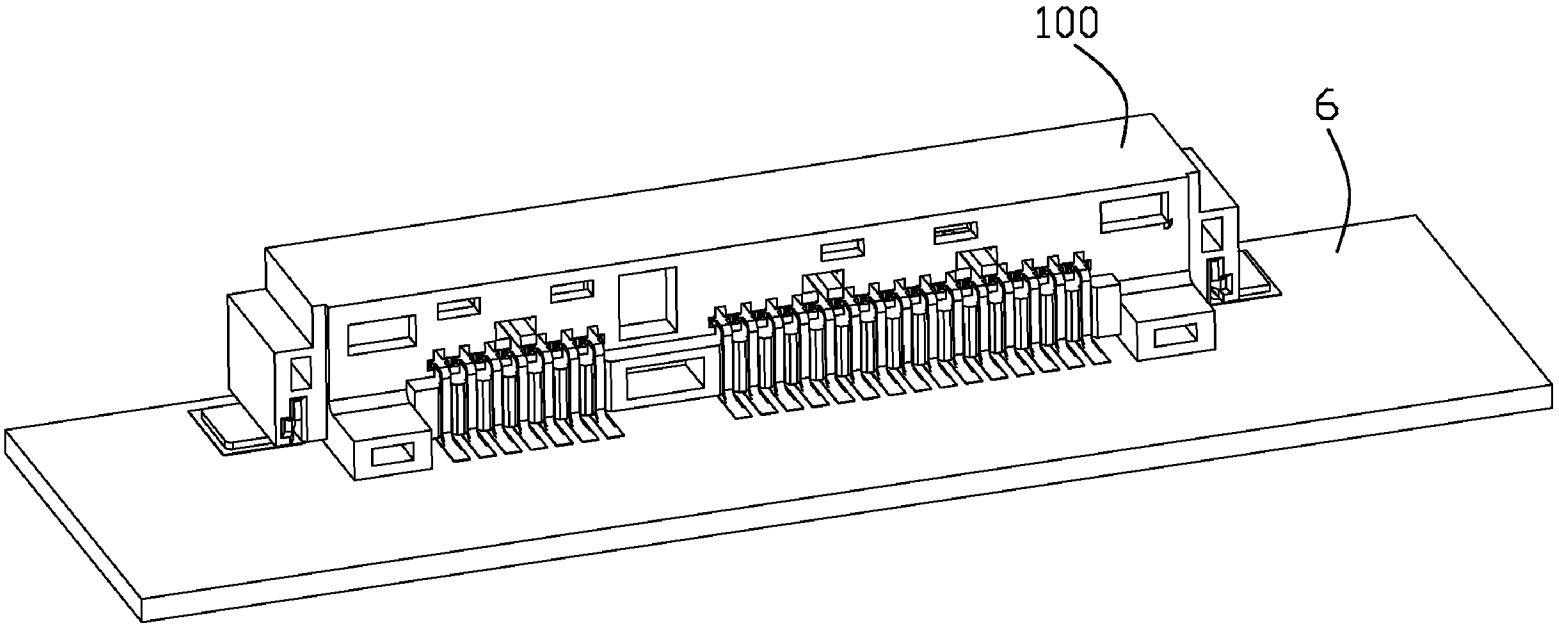
FIG. 2 is another perspective view of the electrical connector assembly of FIG. 1.

Referring to FIGS. 1 to 4, an electrical connector assembly according to an embodiment of the present invention is shown to include a printed circuit board 6 and an electrical connector 100. The electrical connector 100 includes an insulative housing 2, a plurality of terminals 3 retained in the housing 2 and first and second pairs of board locks 4, 5 for attaching the electrical connector 100 to the printed circuit board 6.

Figure 3:
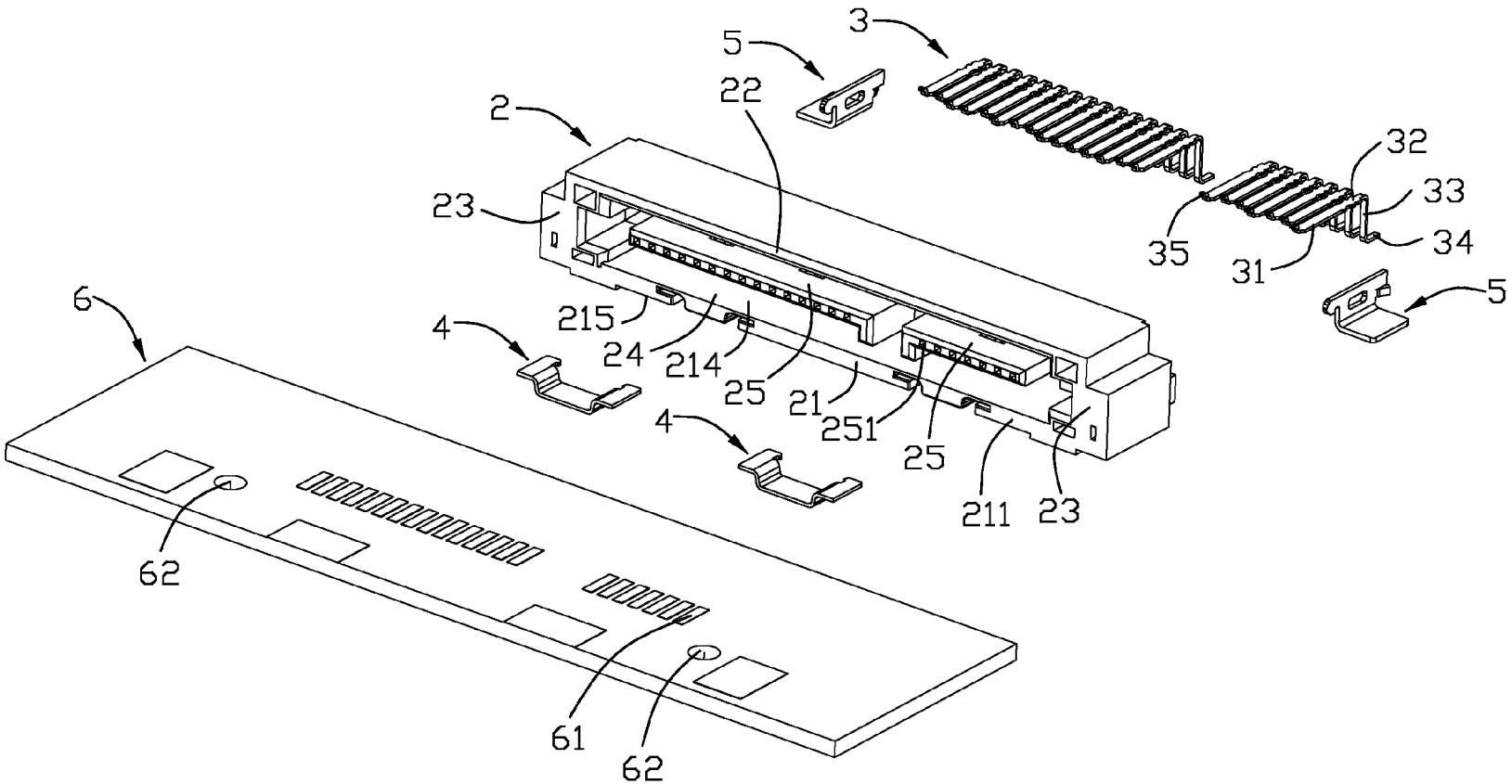
FIG. 3 is an exploded, perspective view of the electrical connector assembly of FIG. 1.
Figure 4:
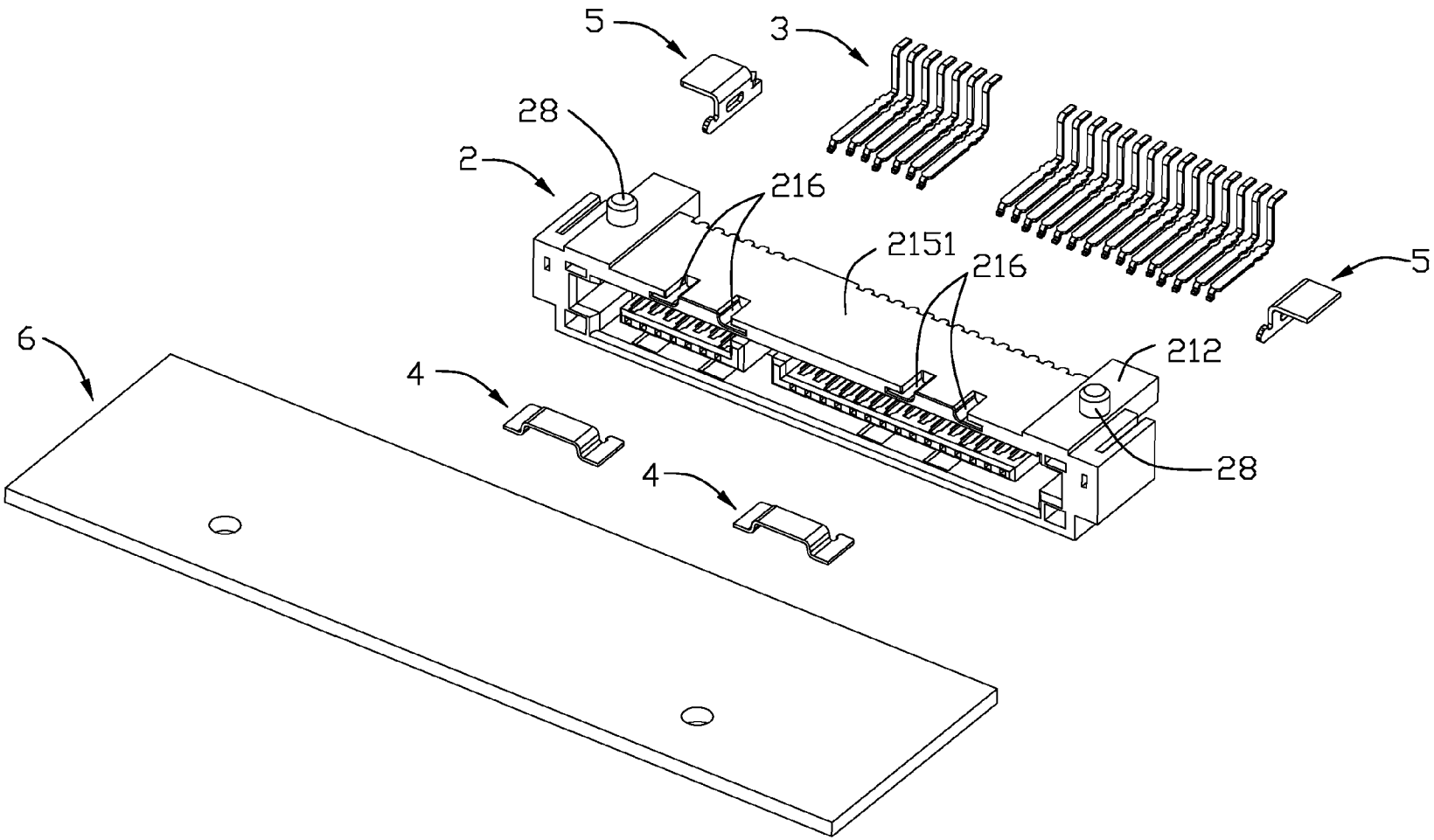
FIG. 4 is another perspective view of the electrical connector assembly of FIG. 3.

Referring particularly to FIGS. 3 to 4, the insulative housing 2 defines a mating surface 211 and comprises a lower wall 21 and an upper wall 22 cooperating with two opposite side walls 23 to commonly define a receiving space 24, a pair of mating tongues 25 extend forwardly and received in the receiving space 24. Each mating tongue 25 defines a plurality of locking holes 251 formed in the mating surface 211. The lower wall 21 defines a mounting surface 212 and an inner surface 214 opposite to the mounting surface 212. A recess 215 is formed in the mounting surface 212 and defines a lower surface 2151, a pair of boardlock-receiving cavities 216 formed in the lower surface 2151 and located between two opposite side walls 23.

Referring particularly to FIG. 3, each conductive terminal 3 defines a retention section 32 retained in the insulative housing 2, a contact section 31 extending from the front end of the retention section 32 and located within corresponding passageway of the mating tongues 25, a transitional section 33 perpendicularly extending from the back end of the retention section 32 toward the mounting surface 212, and a soldering section 34 perpendicularly extending from the transition section 33 and exposing in the mounting face 21 of the lower wall 21 for electrically connecting a corresponding pad 61 disposed in the PCB 6. In addition, a locking section 35 is shaped at a front free end of the contact section 31 and respectively received in the locking holes 251 of the mating tongues 25 for preventing the contact section 31 of terminal 3 from warping.

Figure 5:
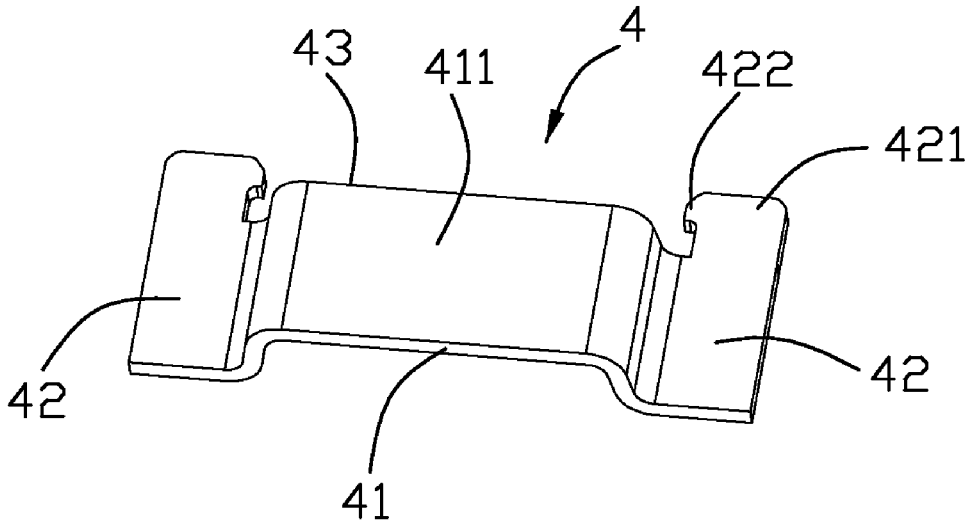
FIG. 5 is a perspective view of the board lock of FIG. 3.

Combination with FIG. 5, each second board lock 4 comprises a body portion 41 received in the recess 215 and a pair of locking arms 42 extending from two sides of the body portion 41 and received in the boardlock-receiving cavity 216. The body portion 41 defines an engaging surface 411 coplanar with the mounting surface 212 for soldering onto the printed circuit board 6. Each second board lock 4 defines an abutment surface 43 and further comprises a pair of extension portions 421 extending from two locking arms 42 beyond the abutment surface 43 respectively. At least one barb 422 is formed at an inner side of each extension portion 421 to interferentially engage with the boardlock-receiving cavity 216. Two locking arms 42 extend toward the inner surface 214 and then diverge a certain distance from each other. In addition, the first pair of board locks 5 are secured in two opposite side walls 23 of the insulative housing. The retention between the second board locks 4 and the electrical connector 100 significantly enhances the retention between the electrical connector 100 and the printed circuit board 6.

In assembly, the terminals 3 are inserted into the insulative housing 2 from a back surface opposite to the front mating face 211, the second pair of board locks 4 are inserted into boardlock-receiving cavities 216 of the insulative housing 2 from the front mating face 211, the other pair of board locks 5 are inserted into two side walls 23 in a back to front direction, respectively. Then, the electrical connector 100 is mounted onto the printed circuit board 6. A pair of posts 28 of the housing 2 are inserted into corresponding holes 62, the first and second board locks 4, 5 are soldered to the printed circuit board 1, the soldering sections 34 of the terminals 3 are soldered to the corresponding pad 61 of the printed circuit board 6, respectively.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector, comprising:

an elongated insulative housing defining a mating interface and a mounting face;

a first pair of soldering pads disposed adjacent to longitudinal ends of the housing; and at least one solder aid disposed in the mounting face and located adjacent to the mating interface;

wherein the insulative housing further comprises at least one mating tongue, the at least one solder aid is located below the at least one mating tongue.

2. The electrical connector as described in claim 1, wherein each solder aid comprises a body portion for locking with a printed circuit board and a pair of locking arms extending from opposite sides of the body portion for retaining the board lock in the insulative housing.

3. The electrical connector as described in claim 2, wherein each solder aid defines an abutment surface and further comprises a pair of extension portions extending from two locking arms beyond the abutment surface respectively, and at least one barb is formed at an inner side of each extension portion.

4. The electrical connector as described in claim 1, wherein a pair of positioning posts extend from the mounting surface of the insulative housing.

5. An electrical connector comprising:

an insulative housing comprising at least one mating tongue and a bottom wall with a mounting face;

a plurality of terminals assembled in the insulative housing;

a pair of first board locks retained at two opposite ends of the housing; and at least one second board lock secured in the bottom wall of the insulative housing and having an engaging surface coplanar with the mounting surface.

6. The electrical connector as described in claim 5, wherein the at least one second board lock is located below the at least one mating tongue.

7. The electrical connector as described in claim 5, wherein each second board lock comprises a body portion for locking with a printed circuit board and a pair of locking arms extending from opposite sides of the body portion for retaining the board lock in the insulative housing.

8. The electrical connector as described in claim 7, wherein each board lock defines an abutment surface and further comprises a pair of extension portions extending from two locking arms beyond the abutment surface respectively, at least one barb is formed at inner side of each extension portion.

9. The electrical connector as described in claim 5, wherein a pair of positioning posts extend from the mounting surface of the insulative housing.

10. An electrical connector comprising:

an insulative housing defining a longitudinal direction thereof and including opposite upper and bottom walls and opposite side walls to commonly define a horizontal mating port;

a plurality of terminals disposed in the housing with mating sections exposed in the mating port; and at least a metallic board lock located under the bottom wall and including a planar body portion adapted to be directly solder upon a printed circuit board, and a pair of L-shaped retaining arms located at two opposite longitudinal ends thereof in said longitudinal direction; wherein said bottom wall defines a pair of L-shaped recess to receive said pair of L-shaped retaining arms.

11. The electrical connector as claimed in claim 10, wherein said board lock is assembled to the bottom wall along a mating direction perpendicular to said longitudinal direction.

12. The electrical connector as claimed in claim 10, wherein said bottom wall defines a mounting surface adapted to be seated upon said printed circuit board under condition that said mounting surface located around two opposite longitudinal ends of the bottom wall with a recess therebetween to receive the body portion of the board lock therein.

13. The electrical connector as claimed in claim 10, further including a pair of board locks at two opposite longitudinal ends of the bottom wall for mounting to the printed circuit board.

* * * * *